US010947479B2

(12) United States Patent
Yamada

(10) Patent No.: US 10,947,479 B2
(45) Date of Patent: Mar. 16, 2021

(54) METHOD FOR WASHING CLOTHING

(71) Applicant: KAO CORPORATION, Tokyo (JP)

(72) Inventor: Kouzou Yamada, Wakayama (JP)

(73) Assignee: KAO CORPORATION, Tokyo (JP)

( * ) Notice: Subject to any disclaimer, the term of this patent is extended or adjusted under 35 U.S.C. 154(b) by 184 days.

(21) Appl. No.: 16/303,589

(22) PCT Filed: May 30, 2017

(86) PCT No.: PCT/JP2017/020062
§ 371 (c)(1),
(2) Date: Nov. 20, 2018

(87) PCT Pub. No.: WO2017/209119
PCT Pub. Date: Dec. 7, 2017

(65) Prior Publication Data

US 2020/0318032 A1 Oct. 8, 2020

(30) Foreign Application Priority Data

May 31, 2016 (JP) ..... JP2016-108446

(51) Int. Cl.

| | |
|---|---|
| ***C11D 1/831*** | (2006.01) |
| ***C11D 1/14*** | (2006.01) |
| ***C11D 3/386*** | (2006.01) |
| ***C11D 11/00*** | (2006.01) |
| ***C11D 17/08*** | (2006.01) |
| ***D06L 1/12*** | (2006.01) |

(52) U.S. Cl.
CPC ..... *C11D 1/143* (2013.01); *C11D 1/831* (2013.01); *C11D 3/38618* (2013.01); *C11D 11/0017* (2013.01); *C11D 17/08* (2013.01); *D06L 1/12* (2013.01)

(58) Field of Classification Search
None
See application file for complete search history.

(56) References Cited

U.S. PATENT DOCUMENTS

| | | | | |
|---|---|---|---|---|
| 5,078,916 | A * | 1/1992 | Kok | C11D 1/143 510/488 |
| 5,312,748 | A | 5/1994 | Liu et al. | |
| 6,139,587 | A | 10/2000 | Nair et al. | |
| 2010/0170045 | A1 | 7/2010 | Showell et al. | |
| 2012/0005842 | A1 | 1/2012 | Schulze | |
| 2014/0038876 | A1 | 1/2014 | Ostergaard et al. | |
| 2014/0079660 | A1 | 3/2014 | Doi | |
| 2014/0080751 | A1 | 3/2014 | Yoshikawa et al. | |
| 2015/0202134 | A1* | 7/2015 | Yoshikawa | A61Q 19/10 510/127 |
| 2018/0265807 | A1* | 9/2018 | Morimoto | A61K 8/86 |

FOREIGN PATENT DOCUMENTS

| | | | |
|---|---|---|---|
| CN | 103476916 | A | 12/2013 |
| CN | 104603251 | A | 5/2015 |
| CN | 105062703 | A | 11/2015 |
| CN | 105255602 | A | 1/2016 |
| EA | 019827 | B1 | 6/2014 |
| EP | 0377261 | A2 | 7/1990 |
| EP | 0482687 | A1 | 4/1992 |
| EP | 2899257 | A1 | 7/2015 |
| EP | 2899258 | A1 | 7/2015 |
| EP | 3088386 | A1 | 11/2016 |
| GB | 2 236 538 | A | 4/1991 |
| JP | 1-161095 | A | 6/1989 |
| JP | 3-126793 | A | 5/1991 |
| JP | 2001-89799 | A | 4/2001 |
| JP | 2001-526741 | A | 12/2001 |
| JP | 2003-81935 | A | 3/2003 |
| JP | 2003-119663 | A | 4/2003 |
| JP | 2007-61101 | A | 3/2007 |
| JP | 2014-77126 | A | 5/2014 |
| JP | 2015-28123 | A | 2/2015 |
| JP | 2015-178548 | A | 10/2015 |
| RU | 2454457 | C2 | 6/2012 |
| WO | WO 2005/098415 | A1 | 10/2005 |
| WO | WO 2014/046176 | A1 | 3/2014 |

OTHER PUBLICATIONS

International Search Report for PCT/JP2017/020062 dated Aug. 1, 2017.
Extended European Search Report for European Application No. 17806672.6, dated Nov. 14, 2019.
International Preliminary Report on Patentability and English translation of the Written Opinion of the International Searching Authority (forms PCT/IB/373 and PCT/ISA/237), dated Dec. 4, 2018, for International Application No. PCT/JP2017/020062.
Singaporean Office Action, dated Mar. 4, 2020, for Singaporean Application No. 11201809141R.
Chinese Office Action and Search Report, dated Jun. 24, 2020, for Chinese Application No. 201780030021.X, with English translation.
Yin, "Synthesis of Internal Olefin Sulfonate," Thesis for the Master Degree, Northeast Petroleum University, TQ325.1, Jun. 10, 2014, pp. 12-13 (17 pages total), with English machine translation.
Russian Office Action and Search Report, dated Oct. 8, 2020, for Russian Application No. 2018145755, with an English translation.
Taiwanese Office Action and Search Report, dated Dec. 17, 2020, for Taiwanese Application No. 106117986.

* cited by examiner

*Primary Examiner* — Necholus Ogden, Jr.
(74) *Attorney, Agent, or Firm* — Birch, Stewart, Kolasch & Birch, LLP

(57) ABSTRACT

The present invention relates to a method for washing clothing, including washing clothing with a detergent liquid having a pH of 3.5 or more and 8.5 or less at 20° C. obtained by mixing the following component (A) and component (B), and water having a hardness:

component (A): an internal olefin sulfonate having 15 or more and 24 or less carbon atoms; and component (B): protease.

19 Claims, No Drawings

METHOD FOR WASHING CLOTHING

FIELD OF THE INVENTION

The present invention relates to a method for washing clothing.

BACKGROUND OF THE INVENTION

Heretofore, an anionic surfactant, particularly an alkylbenzene sulfonate, a nonionic surfactant having an oxyalkylene group having 2 or 3 carbon atoms and an olefin sulfonate, particularly an internal olefin sulfonate obtained by using, as a raw material, an internal olefin having a double bond not at the end of an olefin chain but inside the olefin chain have been widely used as household and industrial detergent components. Protease is also used as a component to increase the detergent property against stains attached to clothing. Many proteases generally have an alkaline optimal pH.

JP-A 2015-28123 and JP-A 2014-77126 disclose an internal olefin sulfonate composition excellent in foamability and the like which contains an internal olefin sulfonate having 16 carbon atoms and an internal olefin sulfonate having 18 carbon atoms in a particular ratio and having a particular ratio of hydroxy form/olefin form. They also describe the use of a solubilizing agent such as propylene glycol.

EP-A 377261 discloses a detergent composition containing an internal olefin sulfonate, in which its β-hydroxy form is 25% or more, having an excellent detergent property. Specifically, it describes a detergent composition containing an internal olefin sulfonate and a nonionic surfactant.

JP-A 2003-81935 discloses a detergent composition containing an internal olefin sulfonate characterized in that it is obtained by sulfonating, neutralizing and hydrolyzing an internal olefin having 8 to 30 carbon atoms in which the total percentage of double bonds present at position 2 is 20 to 95% and the cis/trans ratio is 1/9 to 6/4. In Formulation Example 1, a granular detergent composition for clothing containing an internal olefin sulfonate, a nonionic surfactant having a polyoxyethylene group is described. In Formulation Example 1 or Formulation Example 2, an enzyme is used.

SUMMARY OF THE INVENTION

The present invention provides a method for washing clothing wherein the detergent property of protease against stains containing proteins is less likely to reduce even when the pH of a detergent liquid is weakly acidic to weakly alkaline.

The present inventors have found that by using a given internal olefin sulfonate in combination with protease, even a detergent liquid having a weakly acidic to weakly alkaline pH at which the activity of protease to degrade proteins decreases has a more excellent detergent activity than an alkylbenzene sulfonate conventionally known as a detergent component, and that the choice of pH of the detergent liquid thereby expands.

The present invention relates to a method for washing clothing, including washing clothing with a detergent liquid having a pH of 3.5 or more and 8.5 or less at 20° C. obtained by mixing the following component (A) and component (B), and water having a hardness:

component (A): an internal olefin sulfonate having 15 or more and 24 or less carbon atoms; and component (B): protease.

According to the present invention, it is possible to provide a method for washing clothing which is excellent in a detergent property of protease against stains containing proteins even when a detergent liquid has a weakly acidic to weakly alkaline pH.

EMBODIMENTS OF THE INVENTION

<Component (A)>

Component (A) of the present invention is an internal olefin sulfonate having 15 or more and 24 or less carbon atoms, and has a detergent activity against stains attached to clothing in the present invention. Component (A) is a compound which can prevent a decrease in the detergent activity of component (B) against stains containing proteins more than an alkylbenzene sulfonate which is a general sulfonate, even under weakly acidic to weakly alkaline conditions that the pH of the detergent liquid is 3.5 or more and 8.5 or less at 20° C., particularly when used in combination with component (B) described below.

The number of carbon atoms of an internal olefin sulfonate in component (A) refers to the number of carbon atoms of an internal olefin to which a sulfonate is covalently bonded. The number of carbon atoms of an internal olefin sulfonate in component (A) is, from the viewpoint of further improving the detergent property against stains attached to clothing, 15 or more and preferably 16 or more, and from the viewpoint of preventing a decrease in the detergent activity of component (B) against stains containing proteins even under weakly acidic to weakly alkaline conditions that the pH of the detergent liquid is 3.5 or more and 8.5 or less at 20° C., 24 or less, preferably 22 or less, more preferably 20 or less, further preferably 18 or less, furthermore preferably 17 or less, furthermore preferably 16 or less, or 16.

From the viewpoint of preventing a decrease in the detergent activity of component (B) against stains containing proteins even under weakly acidic to weakly alkaline conditions that the pH of the detergent liquid is 3.5 or more and 8.5 or less at 20° C., component (A) is preferably one or more selected from the following components (a1) and component (a2), and the mass ratio (a2)/(a1) of component (a2) to component (a1) is preferably 0 or more and 1 or less:

component (a1): an internal olefin sulfonate having 15 or more and 16 or less carbon atoms; and component (a2): an internal olefin sulfonate having 17 or more and 24 or less carbon atoms.

From the viewpoint of preventing a decrease in the detergent activity of component (B) against stains containing proteins even under weakly acidic to weakly alkaline conditions that the pH of the detergent liquid is 3.5 or more and 8.5 or less at 20° C., component (a1) is preferably an internal olefin sulfonate having 16 carbon atoms, and component (a2) is preferably an internal olefin sulfonate having 18 carbon atoms.

From the viewpoint of preventing a decrease in the detergent activity of component (B) against stains containing proteins even under weakly acidic to weakly alkaline conditions that the pH of the detergent liquid is 3.5 or more and 8.5 or less at 20° C., the mass ratio (a2)/(a1) of component (a2) to component (a1) is preferably 0 or more, and preferably 1 or less, preferably 0.95 or less, more preferably 0.9 or less, further preferably 0.8 or less, furthermore preferably 0.7 or less, furthermore preferably 0.6 or less, furthermore preferably 0.5 or less, furthermore preferably 0.4 or less, furthermore preferably 0.3 or less, furthermore preferably 0.2 or less, furthermore preferably 0.1 or less, furthermore preferably 0.05 or less and furthermore preferably 0.

The internal olefin sulfonate of the present invention is preferably a sulfonate obtained by sulfonating, neutralizing and hydrolyzing an internal olefin, as a raw material, including an internal olefin having 15 or more and 24 or less carbon atoms with a double bond at position 2 or higher (an olefin having a double bond inside an olefin chain).

Such an internal olefin also includes those containing a trace amount of so-called alpha-olefin (hereinafter also referred to as α-olefin) in which the double bond is present at position 1 of the carbon chain.

When an internal olefin is sulfonated, β-sultone is produced quantitatively, and a part of β-sultone is changed to γ-sultone and an olefin sulfonic acid, and further converted to a hydroxyalkane sulfonate and an olefin sulfonate in the process of neutralization and hydrolysis (e.g., J. Am. Oil Chem. Soc. 69, 39 (1992)). The hydroxy group of the resulting hydroxyalkane sulfonate is inside the alkane chain, and the double bond of the olefin sulfonate is inside the olefin chain. The resulting product contains mainly a mixture of these, and may contain, in some cases, a trace amount of a hydroxyalkane sulfonate having a hydroxy group at the end of its carbon chain or an olefin sulfonate having a double bond at the end of its carbon chain.

In the present specification, each of these products and a mixture thereof are collectively referred to as "internal olefin sulfonate" (component (A)). In addition, "hydroxyalkane sulfonate" is referred to as "hydroxy form of internal olefin sulfonate" (hereinafter also referred to as "HAS"), and "olefin sulfonate" as "olefin form of internal olefin sulfonate" (hereinafter also referred to "IOS").

The mass ratio of HAS to IOS of the compound in component (A) can be measured by high performance liquid chromatography mass spectrometer (hereinafter abbreviated as HPLC-MS). Specifically, the mass ratio can be determined from the HPLC-MS peak area of component (A).

Examples of the salt of the internal olefin sulfonate of component (A) include an alkali metal salt, an alkaline earth metal (1/2 atom) salt, an ammonium salt or an organic ammonium salt. Examples of the alkali metal salt include a sodium salt and a potassium salt. Examples of the organic ammonium salt include an alkanolammonium salt having 2 or more and 6 or less carbon atoms. From the viewpoint of the detergent property, the salt of internal olefin sulfonate is preferably an alkali metal salt, and more preferably a sodium salt.

As is clear from the above-mentioned production method, the sulfonate group of the internal olefin sulfonate of component (A) is present inside the carbon chain, that is, the olefin chain or the alkane chain of the internal olefin sulfonate, and a trace amount of the internal olefin sulfonate with the sulfonate group at the end of its carbon chain may be, in some cases, contained. In the present invention, from the viewpoint of improving the detergent property against stains containing proteins attached to clothing, the content of an internal olefin sulfonate with the sulfonate group at position 2 in component (A) is preferably 10% by mass or more, more preferably 15% by mass or more, further preferably 20% by mass or more, furthermore preferably 25% by mass or more, furthermore preferably 30% by mass or more, furthermore preferably 35% by mass or more and furthermore preferably 40% by mass or more, and preferably 60% by mass or less in component (A).

The content of an olefin sulfonate with the sulfonate group at position 1 in component (A) is, from the viewpoint of further improving the detergent property against stains attached to clothing even when the temperature of water used for washing is a low temperature of 0° C. or more and 15° C. or less, preferably 10% by mass or less, more preferably 7% by mass or less, further preferably 5% by mass or less and furthermore preferably 3% by mass or less in component (A), and from the viewpoint of reducing production cost and improving productivity, preferably 0.01% by mass or more in component (A).

The position of the sulfonate group in these compounds is the position in the olefin chain or the alkane chain.

The internal olefin sulfonate can be a mixture of the hydroxy form and the olefin form. The mass ratio (olefin form/hydroxy form) of the content of the olefin form of internal olefin sulfonate to the content of the hydroxy form of internal olefin sulfonate in component (A) can be 0/100 or more and further 5/95 or more, and 50/50 or less, further 40/60 or less, further 30/70 or less and further 25/75 or less.

The mass ratio of the content of the hydroxy form of internal olefin sulfonate and the content of the olefin form of internal olefin sulfonate in component (A) can be measured by the method described in Examples after separating component (A) into the hydroxy form and the olefin form by HPLC.

Component (A) can be produced by sulfonating, neutralizing and hydrolyzing an internal olefin having 15 or more and 24 or less carbon atoms as a raw material.

The sulfonation can be carried out by allowing 1.0 to 1.2 mol of sulfur trioxide gas to react with 1 mol of the internal olefin. The reaction can be carried out at a reaction temperature of 20 to 40° C.

The neutralization is carried out by allowing an aqueous solution of alkali such as sodium hydroxide, ammonia or 2-aminoethanol to react with the sulfonic acid group in an amount of 1.0 to 1.5 molar times the theoretical value of the sulfonate group.

The hydrolysis may be carried out at 90 to 200° C. for 30 minutes to 3 hours in the presence of water.

These reactions can be carried out continuously. After completion of the reaction, purification can be carried out by extraction, washing or the like.

In producing internal olefin sulfonate of component (A), sulfonation, neutralization and hydrolysis processes may be carried out using an internal olefin having a distribution of 15 or more and 24 or less carbon atoms as a raw material; sulfonation, neutralization and hydrolysis processes may be carried out using an internal olefin having a single number of carbon atoms as a raw material; or if necessary, plural types of internal olefin sulfonate having different numbers of carbon atoms which have previously been produced may be mixed.

In the present invention, the internal olefin refers to an olefin having a double bond inside the olefin chain as described above. The number of carbon atoms of the internal olefin which is the raw material of component (A) is 15 or more and 24 or less. The internal olefin used in component (A) may be used alone or in combination of two or more.

The total content of an olefin having a double bond at position 1, the so-called alpha olefin, in an olefin as a raw material is, from the viewpoint of further improving the detergent property against stains containing proteins, preferably 10% by mass or less, more preferably 7% by mass or less, further preferably 5% by mass or less and furthermore preferably 3% by mass or less, and from the viewpoint of reducing production cost and improving productivity, preferably 0.01% by mass or more.

Component (A) is preferably an internal olefin sulfonate obtained by using as a raw material an olefin including an olefin having 15 or more and 24 or less carbon atoms with a double bond at position 1 or higher and 3 or lower (IO-1) and an olefin having 15 or more and 24 or less carbon atoms with a double bond at position 5 or higher (IO-2) in the mass ratio (IO-1)/(IO-2) of 0.50 or more and 6.5 or less. From the viewpoint of improving the detergent property against stains containing proteins attached to clothing, the mass ratio of (IO-1)/(IO-2) is 0.50 or more, preferably 0.65 or more, more preferably 0.70 or more, further preferably 0.80 or more and furthermore preferably 0.85 or more, and 6.5 or less and preferably 6.0 or less. The position at which the double bond occurs most frequently in the internal olefin as a raw material varies depending on the number of carbon atoms.

Distribution of a double bond in the olefin as a raw material can be measured, for example, by gas chromatograph mass spectrometer (hereinafter abbreviated as GC-MS). Specifically, each component different in the carbon chain length and the double bond position is precisely separated from each other by a gas chromatograph analyzer (hereinafter abbreviated as GC), and each component can be subjected to a mass spectrometer (hereinafter abbreviated as MS) to identify the double bond position, and the percentage of each component can be determined from its GC peak area. The method for measuring the position of a double bond in an internal olefin as a raw material is shown below.

<Method for Measuring Double Bond Position in Internal Olefin as Raw Material>

The position of a double bond in an internal olefin is measured by gas chromatography (hereinafter abbreviated as GC). Specifically, the internal olefin is allowed to react with dimethyl disulfide to form its dithiolated derivative, and each component is then subjected to separation by GC. The double bond distribution of the internal olefin is determined from each of the resulting peak areas.

The devices and the analysis conditions used for the measurement are as follows:

a GC system: "HP6890" (manufactured by Hewlett-Packard Company);

a column: "Ultra-Alloy-1 HT Capillary column" (30 m×250 μm×0.15 μm, manufactured by Frontier Laboratories, Inc.);

a detector (hydrogen flame ionization detector (FID));

injection temperature: 300° C.;

detector temperature: 350° C.; and

He flow rate: 4.6 mL/min.

Component (A) is preferably an internal olefin sulfonate including an internal olefin sulfonate having 15 or more and 24 or less carbon atoms with the sulfonate group at position 2 or higher and position 4 or lower (IO-1S) and an olefin having 15 or more and 24 or less carbon atoms with the sulfonate group at position 5 or higher (IO-2S). (IO-2S) is preferably an olefin having 15 or more and 24 or less carbon atoms with the sulfonate group at position 5 or higher and position 9 or lower. From the viewpoint of improving the detergent property against stains containing proteins attached to clothing, the mass ratio of (IO-1S)/(IO-2S) is preferably 0.65 or more, more preferably 0.70 or more, further preferably 0.75 or more, furthermore preferably 0.80 or more and furthermore preferably 0.85 or more, and 5.0 or less. The position at which the sulfonate group is bonded most frequently in the internal olefin sulfonate varies depending on the number of carbon atoms.

The content of each of compounds with the sulfonate group at different positions in component (A) can be measured by HPLC-MS. In the present specification, the content of each of compounds with the sulfonate group at different positions will be determined as the mass ratio of the compound with the sulfonate group at each position in all HAS forms of component (A), based on the HPLC-MS peak area.

<Component (B)>

Component (B) of the present invention is protease, and has a detergent property against stains containing proteins attached to clothing. The protease may be any enzyme as long as it has an optimum pH, preferably on the neutral to alkaline side, and a plurality of proteases satisfying this condition can be also used in combination. The use of component (A) in combination with component (B) can prevent detergency of component (B) of the prevent invention from changing, even with a protease having an optimum pH on the alkali side and even under a wide range of washing conditions that pH of a detergent liquid is 3.5 and more and 8.5 or less at 20° C. Component (B) of the present invention is preferably a subtilisin protease derived from *Bacillus* sp., and particularly preferably a subtilisin protease derived from *Bacillus halodurans* or *Bacillus clausii*. Examples of the commercially available alkaline protease include Alcalase, Savinase, Everlase, Esperase, Kannase and Ovozyme available from Novozymes Japan Ltd., and Purafect and Properase available from Genencor International, Inc. The protease described in JP-A 2007-61101 can be also suitably used. Component (B) can be used in the form of (1) a liquid containing an enzyme protein, (2) a dried product of an enzyme protein and (3) an enzyme protein-containing particle, for preparing a detergent liquid used in the present invention.

<Water>

In the present invention, water used for preparing a detergent liquid by mixing it with component (A) and component (B) is water with hardness. The hardness of water is, from the viewpoint that it can enjoy the effect of the present invention, by German hardness, preferably 1° dH or more, more preferably 2° dH or more, further preferably 3.5° dH or more, furthermore preferably 5° dH or more and furthermore preferably 7° dH or more, and preferably 20° dH or less, more preferably 18° dH or less and further preferably 15° dH or less. The German hardness (° dH) used in the present specification refers to the concentration of calcium and magnesium in water expressed as the concentration calculated based on the form of $CaCO_3$: 1 mg/L (ppm)=about 0.056° dH (1° dH=17.8 Ppm).

The concentrations of calcium and magnesium for this German hardness are determined by a chelate titration method using disodium ethylenediaminetetraacetate salt.

A specific method for measuring the German hardness of water in the present specification is shown as follows.

<Method for Measuring German Hardness of Water>

[Reagent]

0.01 mol/l EDTA.2Na solution: a 0.01 mol/l aqueous solution of disodium ethylenediaminetetraacetate (a titration solution, 0.01 M EDTA-Na2, manufactured by SIGMA-ALDRICH)

Universal BT indicator (product name: Universal BT, manufactured by Dojindo Laboratories)

Ammonia buffer solution for hardness measurement (a solution prepared by dissolving 67.5 g of ammonium chloride in 570 ml of 28 w/v % ammonia water and adding ion-exchanged water until the total volume is 1000 ml)

[Measurement of Hardness]

(1) 20 ml of water serving as a sample is collected in a conical beaker with a whole pipette.

(2) 2 ml of an ammonia buffer solution for hardness measurement is added thereto.

(3) 0.5 ml of Universal BT indicator is added thereto. It is made sure that the solution after addition is reddish violet.

(4) While shaking the conical beaker well, a 0.01 mol/l EDTA.2Na solution is added dropwise thereto from a burette, and the point at which the sample water turns blue is taken as the end point of the titration. (5) The total hardness is determined by the following calculation formula:

$$\text{Hardness } (^\circ \text{ dH}) = T \times 0.01 \times F \times 56.0774 \times 100/A$$

wherein:

T: Titer of a 0.01 mol/l EDTA.2Na solution (mL),

A: Sample volume (20 mL, a volume of sample water), and

F: Factor of a 0.01 mol/l EDTA.2Na solution.

The detergent liquid used in the present invention is preferably a detergent liquid obtained by mixing component (A), component (B) and water having a hardness of 1° dH or more and 20° dH or less.

<Clothing>

In the present invention, clothing refers to a cloth obtained by using the hydrophobic fibers or hydrophilic fibers, which are described below, such as a woven fabric, a knitted fabric or a nonwoven fabric, and a product obtained by using the cloth such as an undershirt, a T-shirt, a business shirt, a blouse, pants, a hat, a handkerchief, a towel, a knit, socks, an underwear or tights.

<Fibers>

The fibers constituting the above clothing may be either hydrophobic fibers or hydrophilic fibers. Examples of the hydrophobic fiber include a protein-based fiber (such as cow milk protein casein fiber or promix), a polyamide-based fiber (such as nylon), a polyester-based fiber (such as polyester), a polyacrylonitrile-based fiber (such as acrylic), a polyvinyl alcohol-based fiber (such as vinylon), a polyvinyl chloride-based fiber (such as polyvinyl chloride), a polyvinylidene chloride-based fiber (such as vinylidene), a polyolefin-based fiber (such as polyethylene or polypropylene), a polyurethane-based fiber (such as polyurethane), a polyvinyl chloride/polyvinyl alcohol copolymer-based fiber (such as polychlal), a polyalkylene paraoxybenzoate-based fiber (such as benzoate), a polyfluoroethylene-based fiber (such as polytetrafluoroethylene), a glass fiber, a carbon fiber, an alumina fiber, a silicone carbide fiber, a rock fiber, a slag fiber and a metal fiber (a gold thread, a silver thread or a steel fiber). Examples of the hydrophilic fiber include a seed hair fiber (such as cotton, arboreous cotton or kapok), a bast fiber (such as linen, flax, ramie, hemp or jute), vein fiber (such as manila hemp or sisal hemp), coconut fiber, rush, straw, an animal hair fiber (such as wool, mohair, cashmere, camel hair, alpaca, vicuna or angora), a silk fiber (domesticated silkworm silk or wild silkworm silk), a feather and down and a cellulosic fiber (such as rayon, polynosic, cupra or acetate).

<Method for Washing Clothing>

The method for washing clothing of the present invention is a method for washing clothing with a detergent liquid having pH of 3.5 or more and 8.5 or less at 20° C. obtained by mixing the following component (A) and component (B), and water having a hardness:

component (A): an internal olefin sulfonate having 15 or more and 24 or less carbon atoms; and component (B): protease.

From the viewpoint of further improving the detergent property against stains containing proteins at the time of washing clothing, the content of component (A) in the detergent liquid used in the present invention is preferably 50 mg/kg or more, more preferably 80 mg/kg or more, further preferably 100 mg/kg or more, furthermore preferably 200 mg/kg or more, furthermore preferably 500 mg/kg or more and furthermore preferably 700 mg/kg or more, and preferably 4000 mg/kg of less.

The content of component (A) contained in the detergent liquid is based on the value calculated assuming that the counter ion is a sodium ion.

The content of component (B) in the detergent liquid used in the present invention is, as the amount of an enzyme protein, preferably 0.1 mg/kg or more, more preferably 0.2 mg/kg or more, further preferably 0.5 mg/kg or more and furthermore preferably 1 mg/kg or more, and from the viewpoint of washing cost, preferably 100 mg/kg or less, more preferably 50 mg/kg or less, further preferably 30 mg/kg or less and furthermore preferably 10 mg/kg or less.

In the present invention, the amount of an enzyme protein of component (B) used is the value measured by Protein Assay Rapid Kit WAKO (manufactured by Wako Pure Chemical Industries, Ltd.).

The temperature of the detergent liquid is, from the viewpoint of further improving the detergent property against stains containing proteins attached to clothing, preferably 0° C. or more, more preferably 3° C. or more and further preferably 5° C. or more, and from the viewpoint of washing cost, preferably 60° C. or less, more preferably 50° C. or less, further preferably 40° C. or less and furthermore preferably 35° C. or less.

The pH of the detergent liquid at 20° C. is, from the viewpoint of further improving the detergent property against stains containing proteins, 3.5 or more and preferably 4.0 or more, and in terms of preventing the detergent property of protease against stains containing proteins from decreasing in the present invention, by using component (A) in combination with protease which is component (B), even when the pH of the detergent liquid decreases from the alkali side, 8.5 or less, preferably 8.0 or less and more preferably 7.5 or less. The pH can be measured according to the method for measuring pH described below.

<pH Measurement Method>

A pH measuring composite electrode (glass fitting sleeve-type, manufactured by HORIBA, Ltd.) is connected to a pH meter (pH/ion meter F-23, manufactured by HORIBA, Ltd.) and the power is turned on. A saturated potassium chloride aqueous solution (3.33 mol/L) is used as an internal liquid for pH electrode. Next, each of a pH 4.01 standard solution (a phthalate standard solution), a pH 6.86 standard solution (a neutral phosphate standard solution) and a pH 9.18 standard solution (a borate standard solution) is filled in a 100 mL beaker, and immersed in a thermostat bath at 25° C. for 30 minutes. The pH measuring electrode is immersed for 3 minutes in each of the standard solutions adjusted to a constant temperature, and subjected to calibration operation in the order of pH 6.86→pH 9.18→pH 4.01. Each of samples to be measured is adjusted to 25° C., the electrode of the pH meter is immersed in the sample, and the pH after 1 minute is measured.

The value of the bath ratio expressed as the ratio of the amount (liter) of a detergent liquid to the mass (kg) of clothing, that is, the amount (liter) of the detergent liquid/the mass (kg) of clothing (hereinafter sometimes also referred to as "bath ratio") is preferably 2 or more, more preferably 3 or more, further preferably 4 or more and furthermore preferably 5 or more, and preferably 100 or less.

From the viewpoint of allowing stains containing proteins attached to clothing to be easily removed, the time to wash clothing is preferably 1 minute or more, more preferably 2 minutes or more and further preferably 3 minutes or more, and preferably 12 hours or less, more preferably 8 hours or less, further preferably 6 hours or less, furthermore preferably 3 hours or less and furthermore preferably 1 hour or less.

The method for washing clothing of the present invention is suitable as a method for washing clothing by soaking it in a detergent liquid. The method for washing clothing by soaking refers to a method in which clothing is soaked in a detergent liquid for a certain period of time. In the method for washing clothing by soaking it in a detergent liquid, it is preferable that clothing is soaked in a detergent liquid for a certain period of time, and optionally thereafter, the clothing is mixed with the detergent liquid and subjected to stirring-washing manually or by a mechanical force such as a washing machine.

The method for washing clothing of the present invention is suitable for a rotary washing method. The rotary washing method refers to a washing method in which clothing not fixed to a rotating device rotate together with the detergent liquid around the rotation axis. The rotary washing method can be carried out by a rotary type washing machine. Specific examples of the rotary type washing machine include a drum type washing machine, a pulsator type washing machine or an agitator type washing machine. As these rotary type washing machines, machines commercially available for household can be used, respectively. In terms of being able to reduce the amount of water used for one washing, drum type washing machines have recently become rapidly widespread. The drum type washing machines can reduce the amount of water used particularly during washing.

When obtaining a detergent liquid containing component (A), component (B) and water having a hardness, component (A), component (B) and water having a hardness may be introduced separately into a vessel, or materials to be charged including two components selected from component (A), component (B) and water having a hardness and the remaining component may be introduced into a vessel.

When component (A), component (B) and water having a hardness is introduced separately into a vessel, component (A), component (B) and water having a hardness may be introduced into a vessel successively or simultaneously. In addition, each of the components may be added at once or portionwise.

When the materials to be charged including two components selected from component (A), component (B) and water having a hardness and the remaining component is introduced into a vessel, the materials to be charged including two components and the remaining component may be introduced successively or simultaneously. In addition, each of the components may be added at once or portionwise.

<Optional Components>

The detergent liquid used in the present invention can contain components other than component (A), component (B), and water having a hardness.

[Component (C): Surfactants Other than Component (A)]

Surfactants other than component (A) can be used as component (C) in the liquid detergent used in the present invention, as long as they do not interfere with the effect of the present invention. Examples of component (C) include one or more surfactants selected from anionic surfactants other than component (A) and nonionic surfactants. Examples of the component (C) include one or more anionic surfactants selected from the following component (c1), component (c2), component (c3) and component (c4):

component (c1): alkyl or alkenyl sulfate, component (c2): polyoxyalkylene alkyl ether sulfate or polyoxyalkylene alkenyl ether sulfate, component (c3): an anionic surfactant having a sulfonate group (except for component (A)), and component (c4): a fatty acid or a salt thereof.

Specific examples of component (c1) include one or more anionic surfactants selected from alkyl sulfates having an alkyl group having 10 or more and 18 or less carbon atoms and alkenyl sulfates having an alkenyl group having 10 or more and 18 or less carbon atoms. From the viewpoint of improving the detergent property, component (c1) is preferably one or more anionic surfactants selected from alkyl sulfates having an alkyl group having 12 or more and 14 or less carbon atoms, and more preferably one or more anionic surfactants selected from sodium alkyl sulfates having an alkyl group having 12 or more and 14 or less carbon atoms.

Specific examples of component (c2) include one or more anionic surfactants selected from a polyoxyalkylene alkyl sulfate having an alkyl group having 10 or more and 18 or less carbon atoms and having an average number of moles of added alkylene oxide of 1 or more and 3 or less, and a polyoxyalkylene alkenyl ether sulfate having an alkenyl group having 10 or more and 18 or less carbon atoms and having an average number of moles of alkylene oxide of 1 or more and 3 or less. From the viewpoint of improving the detergent property, component (c2) is preferably a polyoxyethylene alkyl sulfate having an average number of moles of added ethylene oxide of 1 or more and 2.2 or less, more preferably a polyoxyethylene alkyl sulfate having an alkyl group having 12 or more and 14 or less carbon atoms and having an average number of moles of ethylene oxide of 1 or more and 2.2 or less, and further preferably a sodium salt thereof.

An anionic surfactant having a sulfonate group as component (c3) refers to an anionic surfactant having a sulfonate as a hydrophilic group (except for component (A)).

Specific examples of component (c3) include one or more anionic surfactants selected from an alkylbenzene sulfonate having an alkyl group having 10 or more and 18 or less carbon atoms, an alkenylbenzene sulfonate having an alkenyl group having 10 or more and 18 or less carbon atoms, an alkane sulfonate having an alkyl group having 10 or more and 18 or less carbon atoms, an α-olefin sulfonate having an α-olefin moiety having 10 or more and 18 or less carbon atoms, an α-sulfofatty acid salt having a fatty acid moiety having 10 or more and 18 or less carbon atoms, and an α-sulfofatty acid lower alkyl ester salt having a fatty acid moiety having 10 or more and 18 or less carbon atoms and an ester moiety having 1 or more and 5 or less carbon atoms, an internal olefin sulfonate having 12 or more and 14 or less carbon atoms. From the viewpoint of improving the detergent property, component (c3) is preferably an alkylbenzene sulfonate having an alkyl group having 11 or more and 14 or less carbon atoms, and more preferably a sodium alkylbenzene sulfonate having an alkyl group having 11 or more and 14 or less carbon atoms.

Examples of a fatty acid or a salt thereof as component (c4) include a fatty acid or a salt thereof having 10 or more and 20 or less carbon atoms. From the viewpoint of further increasing the effect of softening fibers of component (A), the number of carbon atoms of component (c4) is 10 or more, preferably 12 or more and more preferably 14 or more, and 20 or less and preferably 18 or less.

The salt of an anionic surfactant as components (c1) to (c4) is preferably an alkali metal salt, more preferably a sodium salt or a potassium salt, and further preferably a sodium salt.

In addition, examples of component (C) other than those described above include, as component (c5), a nonionic surfactant and preferably a nonionic surfactant having a hydroxy group or polyoxyalkylene group.

Component (c5) is preferably a nonionic surfactant having a polyoxyalkylene group. A preferred component (c5) is a nonionic surfactant containing a polyoxyethylene group and having an HLB of 8 or more and 20 or less. In the present invention, from the viewpoint of a high effect of dispersing proteins degraded by protease in a detergent liquid, the HLB of component (c5) is preferably 9 or more, more preferably 10 or more, further preferably 11 or more, furthermore preferably 12 or more, furthermore preferably 13 or more and furthermore preferably 14 or more, and preferably 20 or less.

The value of HLB of a nonionic surfactant in present invention refers to an HLB calculated by the following formula. The average molecular weight of the polyoxyethylene group refers to the average molecular weight calculated from the average number of added moles when the number of moles of added oxyethylene group has a distribution. The average molecular weight of a nonionic surfactant refers to a molecular weight calculated as an average value when a hydrophobic group such as a hydrocarbon group has a distribution or the number of moles of added polyoxyethylene group has a distribution.

HLB=[(average molecular weight of polyoxyethylene group)/[average molecular weight of a nonionic surfactant]]×20

Hereinafter, specific nonionic surfactants will be illustrated, but the above-mentioned "oxyethylene group" may be sometimes referred to as "ethyleneoxy group".

In the present invention, when the nonionic surfactant contains no polyoxyethylene group, the HLB of the nonionic surfactant refers to a value measured according to the method of Kunieda et al. described in "Journal of Colloid and Interface Science, Vol. 107, No. 1, September 1985". This document describes a measurement method of HLB based on the finding that there is a linear relationship between a particular temperature ($T_{HLB}$) and the number of HLB by Griffin.

Component (c5) is suitably a nonionic surfactant having an HLB of preferably 8 or more and 20 or less and is represented by the following general formula (C5-1):

$$R^1(CO)_m O\text{-}(A^1O)n\text{-}R^2 \quad \text{(C5-1)}$$

wherein $R^1$ is an aliphatic hydrocarbon group having 9 or more and 16 or less carbon atoms, $R^2$ is a hydrogen atom or a methyl group, CO is a carbonyl group, m is 0 or 1, $A^1O$ group is one or more groups selected from an ethyleneoxy group and a propyleneoxy group, and n is an average number of added moles and is 6 or more and 50 or less.

In the general formula (C5-1), $R^1$ is an aliphatic hydrocarbon group having 9 or more and 16 or less carbon atoms. The value of HLB is lower as the number of carbon atoms of $R^1$ is more and is higher as the number of carbon atoms of $R^1$ is less. The number of carbon atoms of $R^1$ is, from the viewpoint of allowing stains attached to fibers to be more easily removed, 9 or more, preferably 10 or more and more preferably 11 or more, and from the viewpoint of having a high effect of dispersing proteins degraded by protease in a detergent liquid, 16 or less, preferably 15 or less and more preferably 14 or less.

The aliphatic hydrocarbon group of $R^1$ is preferably a group selected from an alkyl group and an alkenyl group.

In the general formula (C5-1), the $A^1O$ group is one or more groups selected from an ethyleneoxy group and a propyleneoxy group. When an ethyleneoxy group and a propyleneoxy group are contained, the ethyleneoxy group and the propyleneoxy group may be bonded in block type or random type. From the viewpoint of having a high effect of dispersing proteins degraded by protease in a detergent liquid, the $A^1O$ group is preferably a group containing an ethyleneoxy group. When the $A^1O$ group is an ethyleneoxy group, the HLB value is higher than that when it is a propyleneoxy group.

In the general formula (C5-1), n is an average number of added moles, and is 6 or more and 50 or less. The value of HLB is higher as n is more and is lower as n is less. From the viewpoint of having a high effect of dispersing proteins degraded by protease in a detergent liquid, n is 6 or more, preferably 6.5 or more, more preferably 7 or more, further preferably 8 or more, furthermore preferably 9 or more, furthermore preferably 10 or more and furthermore preferably 12 or more, and n is 50 or less, preferably 45 or less.

[Component (D): Alkali Agent and Buffer Agent]

The method of washing clothing of the present invention can include, as component (D), an alkali agent and a buffer agent as a means of adjusting the pH of detergent liquid. Specific examples of the alkali agent can include one or more inorganic alkali agents selected from sodium carbonate, potassium carbonate, sodium sesquicarbonate and sodium hydrogen carbonate. The inorganic alkali agent is preferably one or more alkali agents selected from sodium carbonate and potassium carbonate, and more preferably sodium carbonate. Examples of the alkali agent other than those described above can include an alkanolamine in which among the groups attached to a nitrogen bond, one or more and three or less groups are alkanol groups having 2 or more and 4 or less carbon atoms and the other(s) are an alkyl group having 1 or more and 4 or less carbon atoms or a hydrogen atom. Among them, the alkanol group of the alkanolamine is preferably a hydroxyalkyl group and further preferably a hydroxyethyl group. Except for the alkanol group, an hydrogen atom or methyl group is preferred, and an hydrogen atom is particularly preferred. Examples of the alkanolamine include an alkanolamine such as 2-aminoethanol, N-methylethanolamine, N,N-dimethylethanolamine, N,N-diethylethanolamine, diethanolamine, N-methyldiethanolamine and triethanolamine. In the present invention, the alkali agent of component (D) is preferably an alkanolamine selected from monoethanolamine and triethanolamine and more preferably monoethanolamine.

Examples of the buffer agent include an acetate buffer, a citrate buffer, an MOPS buffer, a phosphate buffer, a Tris-hydrochloric acid buffer, a glycine-sodium hydroxide buffer, a borate buffer, a carbonate buffer, or a phosphate-sodium hydroxide buffer.

[Optional Step]

In the method for washing clothing of the present invention, clothing after being washed is preferably rinsed with water. Rinsing is carried by removing clothing from the detergent liquid and then squeezing it to remove the detergent liquid or removing the detergent liquid with a spin-dryer and thereafter resoaking the clothing in fresh water [hereinafter referred to as a rinsing water]. The rinsing water may be either water stored in a vessel or the like or running water. The mass ratio of the rinsing water to the clothing is preferably 2 times or more, more preferably 5 times or more and more preferably 10 times or more, and preferably 1,000 times or less, more preferably 500 times or less and preferably 100 times or less. Repeating this operation several times can reduce the amount of component (A) attached to clothing. Water used for rinsing can be water having the same range of German hardness as water mixed with the detergent liquid or water having a German hardness different from water mixed with the detergent liquid. Rinsing can be carried out a plurality of times.

The present invention is one achieved based on the finding that component (A) enhances the detergent activity when combined with component (B). Therefore, the present invention relates to a method for enhancing the detergent activity of component (B), wherein, at the time of washing clothing with a detergent liquid having a pH of 3.5 or more and 8.5 or less at 20° C. obtained by mixing the following component (B) and water having a hardness, component (A) is present in the detergent liquid:

component (A): an internal olefin sulfonate having 15 or more and 24 or less carbon atoms; and component (B): protease.

EMBODIMENTS OF THE PRESENT INVENTION

Embodiments of the present invention will be illustrated as follows. The matters described with respect to the method for washing clothing according to the present invention can be appropriately applied to these embodiments.

<1>

A method for washing clothing, including washing clothing with a detergent liquid having a pH of 3.5 or more and 8.5 or less at 20° C. obtained by mixing the following component (A) and component (B), and water having a hardness:

component (A): an internal olefin sulfonate having 15 or more and 24 or less carbon atoms; and component (B): protease.

<2>

The method for washing clothing according to <1>, wherein component (A) is an internal olefin sulfonate including an internal olefin sulfonate having 15 or more and 24 or less carbon atoms with the sulfonate group at position 2 or higher and position 4 or lower (IO-1S) and an olefin having 15 or more and 24 or less carbon atoms with the sulfonate group at position 5 or higher (IO-2S).

<3>

The method for washing clothing according to <2>, wherein the mass ratio of (IO-1S)/(IO-2S) is preferably 0.50 or more, more preferably 0.65 or more, further preferably 0.70 or more, furthermore preferably 0.75 or more, furthermore preferably 0.80 or more and furthermore preferably 0.85 or more, and preferably 6.5 or less and more preferably 5.0 or less.

<4>

The method for washing clothing according to any one of <1> to <3>, wherein component (A) is an internal olefin sulfonate having 15 or more and 24 or less carbon atoms with the sulfonate group at position 2 or higher and position 4 or lower (IO-1S) and an internal olefin sulfonate having 15 or more and 24 or less carbon atoms with the sulfonate group at position 5 or higher (IO-2S), and the mass ratio of (IO-1S)/(IO-2S) is 0.50 or more, preferably 0.65 or more, more preferably 0.70 or more, further preferably 0.75 or more, furthermore preferably 0.80 or more and furthermore preferably 0.85 or more, and 6.5 or less and preferably 5.0 or less.

<5>

The method for washing clothing according to any one of <2> to <4>, wherein (IO-2S) is an olefin having 15 or more and 24 or less carbon atoms with the sulfonate group at position 5 or higher and position 9 or lower.

<6>

The method for washing clothing according to any one of <1> to <5>, wherein component (A) is one or more selected from the following component (a1) and component (a2), wherein the mass ratio (a2)/(a1) of component (a2) to component (a1) is 0 or more and 1 or less:

component (a1): an internal olefin sulfonate having 15 or more and 16 or less carbon atoms; and component (a2): an internal olefin sulfonate having 17 or more and 24 or less carbon atoms.

<7>

The method for washing clothing according to <6>, wherein component (a1) is an internal olefin sulfonate having 16 carbon atoms and component (a2) is an internal olefin sulfonate having 18 carbon atoms.

<8>

The method for washing clothing according to <6> or <7>, wherein the mass ratio (a2)/(a1) of component (a2) to component (a1) is 0.95 or less, more preferably 0.9 or less, further preferably 0.8 or less, furthermore preferably 0.7 or less, furthermore preferably 0.6 or less, furthermore preferably 0.5 or less, furthermore preferably 0.4 or less, furthermore preferably 0.3 or less, furthermore preferably 0.2 or less, furthermore preferably 0.1 or less, furthermore preferably 0.05 or less and furthermore preferably 0.

<9>

The method for washing clothing according to any one of <1> to <8>, wherein the content of the internal olefin sulfonate with the sulfonate group at position 2 in component (A) is preferably 10% by mass or more, more preferably 15% by mass or more, further preferably 20% by mass or more, furthermore preferably 25% by mass or more, furthermore preferably 30% by mass or more, furthermore preferably 35% by mass or more and furthermore preferably 40% by mass or more, and preferably 60% by mass or less in component (A).

<10>

The method for washing clothing according to any one of <1> to <9>, wherein the content of the olefin sulfonate with the sulfonate group at position 1 in component (A) is preferably 10% by mass or less, more preferably 7% by mass or less, further preferably 5% by mass or less and furthermore preferably 3% by mass or less, and preferably 0.01% by mass or more in component (A).

<11>

The method for washing clothing according to any one of <1> to <10>, wherein component (B) is a subtilisin protease derived from *Bacillus* sp. and preferably a subtilisin protease derived from *Bacillus halodurans* or *Bacillus clausii*.

<12>

The method for washing clothing according to any one of <1> to <11>, wherein the hardness of water having a hardness is, by German hardness, preferably 1° dH or more, more preferably 2° dH or more, further preferably 3.5° dH or more, furthermore preferably 5° dH or more and furthermore preferably 7° dH or more, and preferably 20° dH or less, more preferably 18° dH or less and further preferably 15° dH or less.

<13>

The method for washing clothing according to any one of <1> to <12>, wherein the content of component (A) in the detergent liquid is 50 mg/kg or more and 4000 mg/kg or less.

<14>

The method for washing clothing according to any one of <1> to <13>, wherein the content of component (A) in the detergent liquid is preferably 50 mg/kg or more, more preferably 80 mg/kg or more, further preferably 100 mg/kg or more, furthermore preferably 200 mg/kg or more, furthermore preferably 500 mg/kg or more and furthermore preferably 700 mg/kg or more, and preferably 4000 mg/kg or less and more preferably 3000 mg/kg or less.

<15>

The method for washing clothing according to any one of <1> to <14>, wherein the content of component (B) in the detergent liquid is, as the amount of an enzyme protein, preferably 0.1 mg/kg or more, more preferably 0.2 mg/kg or more, further preferably 0.5 mg/kg or more and furthermore preferably 1 mg/kg or more, and preferably 100 mg/kg or less, more preferably 50 mg/kg or less, further preferably 30 mg/kg or less and furthermore preferably 10 mg/kg or less.

<16>

The method for washing clothing according to any one of <1> to <15>, wherein the pH of the detergent liquid at 20° C. is 3.5 or more and preferably 4.0 or more, and 8.5 or less, preferably 8.0 or less and more preferably 7.5 or less.

<17>

The method for washing clothing according to any one of <1> to <16>, wherein the time to wash clothing is preferably 1 minute or more, more preferably 2 minutes or more and further preferably 3 minutes or more, and preferably 12 hours or less, more preferably 8 hours or less, further preferably 6 hours or less, furthermore preferably 3 hours or less and furthermore preferably 1 hour or less.

<18>

The method for washing clothing according to any one of <1> to <17>, wherein clothing is washed by being soaked in the detergent liquid.

<19>

The method for washing clothing according to <18>, wherein clothing is soaked in the detergent liquid, and thereafter the clothing is mixed with the detergent liquid and subjected to stirring-washing.

<20>

The method for washing clothing according to any one of <1> to <19>, wherein clothing after being washed is rinsed with water.

<21>

The method for washing clothing according to any one of <1> to <20>, wherein the detergent liquid contains, as component (C), a surfactant other than component (A) and preferably contains a nonionic surfactant having a hydroxy group or polyoxyalkylene group.

<22>

The method for washing clothing according to <21>, wherein component (C) is a nonionic surfactant having an HLB of preferably 8 or more and 20 or less and represented by the following general formula (C5-1):

$$R^1(CO)_m O\text{-}(A^3O)n\text{-}R^2 \quad \text{(C5-1)}$$

wherein $R^1$ is an aliphatic hydrocarbon group having 9 or more and 16 or less carbon atoms, $R^2$ is a hydrogen atom or a methyl group, CO is a carbonyl group, m is 0 or 1, $A^1O$ group is one or more groups selected from an ethyleneoxy group and a propyleneoxy group, and n is an average number of added moles and is 6 or more and 50 or less.

<23>

A method for enhancing the detergent activity of the following component (B), wherein, at the time of washing clothing with a detergent liquid having a pH of 3.5 or more and 8.5 or less at 20° C. obtained by mixing component (B) and water having a hardness, component (A) is present in the detergent liquid:

component (A): an internal olefin sulfonate having 15 or more and 24 or less carbon atoms; and component (B): protease.

EXAMPLES

Synthesis of Component (A)

(1) Synthesis of Internal Olefins A (Production Example A)

Internal olefin A used as a raw material for component (A) was synthesized as follows.

7000 g (28.9 mol) of 1-hexadecanol (product name: KALCOL 6098, manufactured by Kao Corporation) and 700 g of γ-alumina (Strem Chemicals, Inc.) as a solid acid catalyst were introduced into a flask equipped with a stirring device, and allowed to react at 280° C. with stirring for a different reaction time for each of Production Examples A to C while passing nitrogen (7000 mL/min) in the flask. The resulting crude internal olefin was transferred to a distillation flask and subjected to distillation at 136 to 160° C./4.0 mmHg to obtain each of internal olefins A having 16 carbon atoms at an olefin purity of 100%. The double bond distribution of each of the obtained internal olefins A is shown in Table 1.

(2) Synthesis of Internal Olefins B (Production Example B)

By replacing 1-hexadecanol (KALCOL 6098) in Production Example A described above with 7000 g (28.9 mol) of 1-octadecanol (product name: KALCOL 8098, manufactured by Kao Corporation), an internal olefin B having 18 carbon atoms as a raw material for component (B) was obtained. The double bond distribution of internal olefin B obtained is shown in Table 1.

TABLE 1

| | | Internal olefin | |
|---|---|---|---|
| | | A | B |
| Number of carbon atoms of hydrocarbon group | | 16 | 18 |
| Distribution of double bond in olefin as raw material (% by mass) | Position 1 | 1.8 | 0.9 |
| | Position 2 | 40.7 | 25 |
| | Position 3 | 29.3 | 21.9 |
| | Position 4 | 15.7 | 19 |
| | Position 5 | 7.3 | 13.6 |
| | Position 6 | 3.0 | 8.6 |
| | Position 7 | 1.1 | 5.6 |
| | Position 8 | 1.1 | 2.7 |
| | Position 9 | 0.0 | 2.7 |
| | Total | 100.0 | 100.0 |
| | Total of positions 5 to 9 | 12.5 | 33.2 |

The double bond distribution of each of the internal olefins was measured by gas chromatography (hereinafter abbreviated as GC). Specifically, the internal olefin was reacted with dimethyl disulfide to form its dithiolated derivative, and then each component was subjected to separation by GC. The double bond distribution of internal olefin was determined from each of the resulting peak areas. For the olefins having 16 carbon atoms, the internal olefin having a double bond at position 7 and the internal olefin having a double bond at position 8 cannot be distinguished from each other in structure but distinguished when they are sulfonated. Therefore, the value obtained by dividing the amount of the internal olefin having a double bond at position 7 by 2 is conveniently shown in the each of the columns for positions 7 and 8. Similarly, for the olefins having 18 carbon atoms, the internal olefin having a double bond at position 8 and the internal olefin having a double bond at position 9 cannot be distinguished from each other in structure but distinguished when they are sulfonated. Therefore, the value obtained by dividing the amount of the internal olefin having a double bond at position 8 by 2 is conveniently shown in the each of the columns for positions 8 and 9.

The devices and the analysis conditions used for the measurement are as follows: a GC system: "HP6890" (manufactured by Hewlett-Packard Company); a column: "Ultra-Alloy-1 HT Capillary Column" (30 m×250 μm×0.15 μm, manufactured by Frontier Laboratories, Ltd.); a detector (hydrogen flame ionization detector (FID)); injection temperature: 300° C.; detector temperature: 350° C.; and He flow rate: 4.6 mL/min.

(3) Production of Internal Olefin Sulfonates Having 16 Carbon Atoms

The internal olefin A obtained in Production Example A was subjected to sulfonation reaction by passing sulfur trioxide therethrough using a thin film-type sulfonation reactor equipped with an external jacket while passing cooling water at 20° C. through the external jacket. The molar ratio of $SO_3$/the internal olefin during the sulfonation reaction was set at 1.09. The resulting sulfonated product was added to an alkaline aqueous solution which had been prepared using sodium hydroxide in an amount of 1.5 molar times the theoretical acid value, and the mixture was neutralized at 30° C. for 1 hour while being stirred. The neutralized product was hydrolyzed by being heated in an autoclave at 160° C. for 1 hour to obtain a crude product of a sodium internal olefin sulfonate having 16 carbon atoms. 300 g of the crude product was transferred to a separating funnel, 300 mL of ethanol was added thereto and petroleum ether was then added thereto in an amount of 300 mL per one time to extract and remove oil-soluble impurities. At this time, inorganic compounds (mainly including sodium sulfate decahydrate) which precipitated at the oil/water interface by the addition of ethanol was also separated and removed from an aqueous phase by oil-water separation procedure. This extraction and removal procedure was carried out three times. The aqueous phase was evaporated to dryness to obtain (a-1) which is a sodium internal olefin sulfonate having 16 carbon atoms.

(a-1) had the mass ratio of the olefin form/the hydroxy form of 8/92. The mass ratio of the olefin form/the hydroxy form was measured by HPLC-MS. Specifically, identification was carried out by separating the hydroxy form and the olefin form by HPLC and subjecting them to MS. Each percentage was determined from the resulting HPLC-MS peak areas.

The devices and the analysis conditions used for the measurement are as follows: an HPLC device: "Agilent Technology 1100" (manufactured by Agilent Technologies); a column: "L-column ODS" (4.6×150 mm, manufactured by Chemicals Evaluation and Research Institute, Japan); sample preparation (1000 times diluted with methanol); eluent A (10 mM ammonium acetate-added water), eluent B (10 mM ammonium acetate-added methanol); gradient (0 min (A/B=30/70%)→10 minutes (30/70%)→55 minutes (0/100%)→65 minutes (0/100%)→66 minutes (30/70%) →75 minutes (30/70%); an MS device: "Agilent Technology 1100MSSL (G1946D)" (manufactured by Agilent Technologies); and MS detection (negative ion detection, m/z: 60-1600, UV 240 nm).

(4) Production of Internal Olefin Sulfonates Having 18 Carbon Atoms

Internal olefin B was subjected to sulfonation reaction by passing sulfur trioxide gas therethrough using a thin film-type sulfonation reactor equipped with an external jacket while passing cooling water at 20° C. through the external jacket. The molar ratio of $SO_3$/the internal olefin during the sulfonation reaction was set at 1.09. The resulting sulfonated product was added to an alkaline aqueous solution which had been prepared using sodium hydroxide in an amount of 1.5 molar times the theoretical acid value, and the mixture was neutralized at 30° C. for 1 hour while being stirred. The neutralized product was hydrolyzed by being heated in an autoclave at 160° C. for 1 hour to obtain a crude product of each sodium internal olefin sulfonate. 300 g of the crude product was transferred to a separating funnel, 300 mL of ethanol was added thereto and petroleum ether in an amount of 300 mL per time was then added thereto to extract and remove oil-soluble impurities. At this time, inorganic compounds (mainly including sodium sulfate decahydrate) which precipitated at the oil/water interface by the addition of ethanol was also separated and removed from the aqueous phase by oil-water separation operation. This extraction and removal operation was carried out three times. The aqueous phase was evaporated to dryness to obtain each of the following sodium internal olefin sulfonates. The mass ratio of the olefin form (sodium olefin sulfonate)/the hydroxy form (sodium hydroxyalkane sulfonate) of each component is 17/83.

The percentage of the content of the internal olefin sulfonate with the sulfonate group attached thereto of each component was measured by high performance liquid chromatography/mass spectrometer (HPLC-MS). Specifically, identification was carried out by separating the hydroxy form having a sulfonic acid group attached thereto by high performance liquid chromatography (HPLC) and subjecting it to mass spectrometer (MS). Each percentage was determined from the resulting HPLC-MS peak area. In the present specification, each percentage determined from the peak area was calculated as percentage by mass.

The devices and the analysis conditions used for the measurement are as follows: an HPLC device: "LC-20ASXR" (manufactured by Shimadzu Corporation); a column: "ODS Hypersil®" (4.6×250 mm, particle size: 3 μm, manufactured by Thermo Fisher Scientific K.K.); sample preparation (1000 times diluted with methanol); eluent A (10 mM ammonium acetate-added water); eluent B (a 10 mM ammonium acetate-added methacrylonitrile/water=95/5 (v/v) solution); gradient (0 minute (A/B=60/40)→15.1 to 20 minutes (30/70)→20.1 to 30 minutes (60/40); an MS device "LCMS-2020" (manufactured by Shimadzu Corporation); ESI detection (negative ion detection, m/z: 349.15 (component (A) having 18 carbon atoms), 321.10 (component (A) having 16 carbon atoms); column temperature (40° C.); flow rate (0.5 mL/min); and injection volume (5 μL).

In addition, the distribution of the positions of the carbon through which each of sulfonate groups of (a-1) and (a-2) obtained is attached is shown in Table 2.

TABLE 2

| | | | Component (A) | |
|---|---|---|---|---|
| | | | (a-1) | (a-2) |
| Number of carbon atoms of hydrocarbon group | | | 16 | 18 |
| Distribution of sulfonate group (% by mass) | Position 1 | | 0.7 | 1.4 |
| | (IO-1S) | Position 2 | 32.1 | 22.1 |
| | | Position 3 | 24.2 | 17.3 |
| | | Position 4 | 25.8 | 21.8 |
| | (IO-2S) | Positions 5 to 9 | 17.2 | 37.4 |
| | Total | | 100.0 | 100 |
| | (IO-1S) (% by mass) | | 82.1 | 61.2 |
| | (IO-2S) (% by mass) | | 17.2 | 37.4 |
| (IO-1S)/(IO-2S) mass ratio | | | 4.8 | 1.6 |

<Components to be Blended>

[Component (A)]

(a-1): a sodium internal olefin sulfonate obtained from internal olefin A. The mass ratio of the olefin form (sodium olefin sulfonate)/the hydroxy form (sodium hydroxyalkane sulfonate) in the sodium internal olefin sulfonate: 8/92

(a-2): a sodium internal olefin sulfonate obtained from internal olefin B

The mass ratio of the olefin form (sodium olefin sulfonate)/the hydroxy form (sodium hydroxyalkane sulfonate) in the sodium internal olefin sulfonate: 17/83

[Component (A'): Comparative Compound of Component (A)]

(a'-1): a sodium alkylbenzene sulfonate (Neopelex G-15, manufactured by Kao Corporation)

(A) or component (A') and optionally component (C) at a ratio shown in Table 3 so that the total of the final concentrations in the detergent liquid was 2500 mg/kg. Component (B) was added thereto so that the protein concentration was 2.4 mg/kg or 6 mg/kg, to prepare a detergent liquid. The protein concentration in the enzyme preparation was measured by Protein Assay Rapid Kit WAKO (manufactured by Wako Pure Chemical Industries, Ltd.). The pH of the detergent liquid was measured according to the method for measuring pH described above.

Cut pieces of artificially stained cloth CFT AS-10 (milk/peanut oil/pigment stained, manufactured by CFT Company) obtained by cutting it into 1 cm×1 cm square was placed and soaked in 5 mL of the detergent liquid prepared above at 25° C. for 30 minutes. The bath ratio was 90. Thereafter, cut pieces were rinsed with tap water and air dried. The brightness was measured by using a color difference meter (MINOLTA, CM3500d), and the washing percentage was calculated from a change in the brightness before and after washing according to the following equation.

In addition, cut pieces were washed with water adjusted to pH 9 with 10 mM Tris-hydrochloric acid and the washing percentage was calculated in the similar manner.

The results are shown in table 3.

$$\text{Washing percentage (\%)}=(L2-L1)/(L0-L1)\times 100$$

wherein:

L0: a brightness of the raw cloth of the stained cloth,

L1: a brightness of the stained cloth before washing, and

L2: a brightness of the stained cloth after washing.

TABLE 3

| | | | Example 1-1 | Comparative Example 1-1 | Example 1-2 | Comparative Example 1-2 | Example 1-3 | Comparative Example 1-3 | Example 1-4 |
|---|---|---|---|---|---|---|---|---|---|
| Composiiton of detergent liquid (mg/kg) | (A) | (a-1) | 2500 | | 2000 | | 2000 | | 1500 |
| | | (a-2) | | | | | | | 1000 |
| | (A') | (a'-1) | | 2500 | | 2000 | | 2000 | |
| | (B) | (b-1) | 2.4 | 2.4 | 2.4 | 2.4 | | | 2.4 |
| | | (b-2) | | | | | 6 | 6 | |
| | (C) | (c-1) | | | 500 | 500 | 500 | 500 | |
| | Water (hardness: 10° dH) | | Balance | Balance | Balance | Balance | Balance | Balance | Balance |
| Evaluation results | | Washing percentage at pH 9: X (%) | 37.7 | 39.4 | 35.7 | 35.5 | 38.2 | 38.5 | 36.8 |
| | | Washing percentage at pH 7.5: Y (%) | 31.5 | 27.1 | 29.4 | 23.1 | 31.5 | 26.1 | 30.0 |
| | | (Washing percentage Y/washing percentage X) × 100 (%) | 84 | 69 | 82 | 65 | 82 | 68 | 82 |

[Component (B)]

Component (b-1): a protease formulation (manufactured by Kao Corporation)

Component (b-2): Savinase 16L enzyme preparation (manufactured by Novozymes A/S)

[Component (C)]

(c-1): a polyoxyethylene lauryl ether (average number of moles of added oxyethylene group: 40 mol)

[Water]

Water obtained by adjusting the hardness of ion-exchanged water to 10° dH by using calcium chloride and magnesium chloride at the mass ratio of 8/2 (calcium chloride/magnesium chloride).

[Washing Test 1]

The water having a hardness of 10° dH (the mass ratio of the hardness components is calcium chloride:magnesium chloride=8:2) was adjusted to pH 7.5 (20° C.) with 10 mM Tris-hydrochloric acid. To this water were added component The results of Table 3 show that when comparing the detergency of the detergent liquid having a pH of 9 with the detergency of the detergent liquid having a pH of 7.5, the washing method using protease in combination with component (A) of the present invention is lower in the degree of decrease in the washing percentage due to a decrease in pH than the washing method using protease in combination with an alkylbenzene sulfonate which is a common sulfonate, and can keep the detergency better than the latter method. It is also shown that the washing method using protease in combination with component (A) of the present invention is higher in the detergency than the washing method using protease in combination with an alkylbenzene sulfonate which is a common sulfonate.

[Washing Test 2]

The water having a hardness of 10° dH (the mass ratio of the hardness components is calcium chloride:magnesium chloride=8:2) was adjusted to pH 7.5 (20° C.) with 10 mM Tris-hydrochloric acid. To this water was added component (A) or component (A') so that the final concentration was 250, 500, 1000, 2000 or 4000 mg/kg. (a-1) was used as component (A), and (a'-1) was used as component (A'). A detergent liquid was prepared by adding thereto the Savinase 16L enzyme preparation (Novozymes A/S) of (b-2) so that the protein concentration is 6 mg/kg. The protein concentration in the enzyme preparation was measured by Protein Assay Rapid Kit WAKO (manufactured by Wako Pure Chemical Industries, Ltd.). The pH of the detergent liquid was measured according to the method for measuring pH described above.

Cut pieces of artificially stained cloth CFT AS-10 (milk/peanut oil/pigment stained, manufactured by CFT Company) obtained by cutting into 1 cm×1 cm square was placed and soaked in 5 mL of the detergent liquid prepared above at 25° C. for 30 minutes. The bath ratio was 90. Thereafter, cut pieces were rinsed with tap water and air dried. Thereafter, the washing percentage was calculated in the same manner as in Washing Test 1. The results are shown in Table 4.

TABLE 4

| | | | Test Example | | | | |
|---|---|---|---|---|---|---|---|
| | | | 2-1 | 2-2 | 2-3 | 2-4 | 2-5 |
| Compositon of detergent liquid (mg/kg) | Component (A) or component (A') | | 250 | 500 | 1000 | 2000 | 4000 |
| | (B) | (b-2) | 6 | 6 | 6 | 6 | 6 |
| | Water (hardness: 10° dH) | | Balance | Balance | Balance | Balance | Balance |
| pH of detergent liquid (20° C.) | | | 7.5 | 7.5 | 7.5 | 7.5 | 7.5 |
| Evaluation results | Washing percentage (1) [Example] | Component (A):(a-1) | 13.5 | 16.8 | 19.0 | 24.4 | 29.7 |
| | Washing percentage (2) [Comparative Example] | (Component (A'):(a'-1) | 10.1 | 9.9 | 10.4 | 16.2 | 26.0 |
| | Washing percentage (1)/washing percentage (2) ratio | | 1.3 | 1.7 | 1.8 | 1.5 | 1.1 |

The results of Table 4 show that even when the concentration of component (A) in the detergent liquid varies, the washing method using protease in combination with component (A) of the present invention is higher in the detergency than the washing method using protease in combination with an alkylbenzene sulfonate which is a common sulfonate.

[Washing Test 3]

The water having a hardness of 10° dH (the mass ratio of the hardness components of calcium chloride to magnesium chloride is calcium chloride: magnesium chloride=8:2) was adjusted to pH 7.0, 7.5, 8.0, 8.5, or 9.0 with 10 mM Tris-hydrochloric acid. To each water was added component (A) or component (A') so that the final concentration was 1000 mg/kg. (a-1) was used as component (A), and (a'-1) was used as component (A'). A detergent liquid was prepared by adding Component (B) thereto so that the protein concentration was 6 mg/kg. The protein concentration in the enzyme preparation was measured by Protein Assay Rapid Kit WAKO (manufactured by Wako Pure Chemical Industries, Ltd.). The pH of the detergent liquid in Table 5 is pH of the detergent liquid containing component (A) or component (A') and component (B).

Cut pieces of artificially stained cloth CFT AS-10 (milk/peanut oil/pigment stained, manufactured by CFT Company) obtained by cutting into 1 cm×1 cm square was placed and soaked in 5 mL of the detergent liquid prepared above at 25° C. for 30 minutes. The bath ratio was 90. Thereafter, cut pieces were rinsed with tap water and air dried. Thereafter, the washing percentage was calculated in the same manner as in Washing Test 1. The results are shown in Table 5.

TABLE 5

| | | | Test Example | | | |
|---|---|---|---|---|---|---|
| | | | 3-1 | 3-2 | 3-3 | 3-4 |
| Composition of detergent liquid (mg/kg) | Component (A) or component (A') | | 1000 | 1000 | 1000 | 1000 |
| | (B) | (b-2) | 6 | 6 | 6 | 6 |
| | Water (hardness: 10° dH) | | Balance | Balance | Balance | Balance |
| pH of detergent liquid (20° C.) | | | 7.0 | 7.5 | 8.0 | 8.5 |
| Evaluation results | Washing percentage (3) [Example] | Component (A):(a-1) | 15 | 20 | 28 | 30 |
| | Washing percentage (4) [Comparative Example] | Component (A'):(a'-1) | 6.3 | 11 | 20 | 26 |
| | Washing percentage (3)/washing percentage (4) ratio | | 2.4 | 1.8 | 1.4 | 1.2 |

The results of Table 5 show that even when the pH of the detergent liquid varies, the washing method using protease in combination with component (A) of the present invention is higher in the detergency than the washing method using protease in combination with an alkylbenzene sulfonate which is a common sulfonate.

The invention claimed is:

1. A method for washing clothing, comprising washing clothing with a detergent liquid having a pH of 3.5 or more and 8.5 or less at 20° C. obtained by mixing the following component (A) and component (B), and water having a hardness:

component (A): an internal olefin sulfonate including an internal olefin sulfonate having 15 or more and 24 or less carbon atoms with the sulfonate group at position 2 or higher and position 4 or lower (IO-1S) and an olefin having 15 or more and 24 or less carbon atoms with the sulfonate group at position 5 or higher (IO-2S); and component (B): protease.

2. The method for washing clothing according to claim 1, wherein a mass ratio of (IO-1S)/(IO-2S) is 0.50 or more and 6.5 or less.

3. The method for washing clothing according to claim 1, wherein the component (A) is one or more selected from the following component (a1) and component (a2), and a mass ratio (a2)/(a1) of the component (a2) to the component (a1) is 0 or more and 1 or less:

component (a1): an internal olefin sulfonate having 15 or more and 16 or less carbon atoms; and component (a2): an internal olefin sulfonate having 17 or more and 24 or less carbon atoms.

4. The method for washing clothing according to claim 1, wherein a content of an internal olefin sulfonate with the sulfonate group at position 2 in the component (A) is 10% by mass or more and 60% by mass or less.

5. The method for washing clothing according to claim 1, wherein a content of an internal olefin sulfonate with the sulfonate group at position 1 in the component (A) is 10% by mass or less and 0.01% by mass or more.

6. The method for washing clothing according to claim 1, wherein the component (B) is a subtilisin protease derived from *Bacillus* sp.

7. The method for washing clothing according to claim 1, wherein the hardness of water having a hardness is, by German hardness, 1° dH or more and 20° dH or less.

8. The method for washing clothing according to claim 1, wherein a content of the component (A) in the detergent liquid is 50 mg/kg or more and 4000 mg/kg or less.

9. The method for washing clothing according to claim 1, wherein a content of the component (B) in the detergent liquid is, as an amount of an enzyme protein, 0.1 mg/kg or more and 100 mg/kg or less.

10. The method for washing clothing according to claim 1, wherein the pH of the detergent liquid at 20° C. is 4.0 or more and 8.0 or less.

11. The method for washing clothing according to claim 1, wherein time to wash clothing is 1 minute or more and 12 hours or less.

12. The method for washing clothing according to claim 1, wherein clothing is washed by being soaked in the detergent liquid.

13. The method for washing clothing according to claim 12, wherein clothing is soaked in the detergent liquid, and thereafter the clothing is mixed with the detergent liquid and subjected to stirring-washing.

14. The method for washing clothing according to claim 1, wherein clothing after being washed is rinsed with water.

15. The method for washing clothing according to claim 1, wherein the detergent liquid further contains, as a component (C), a surfactant other than the component (A).

16. The method for washing clothing according to claim 15, wherein the component (C) is a nonionic surfactant having a hydroxy group or polyoxyalkylene group.

17. The method for washing clothing according to claim 16, wherein the component (C) is a nonionic surfactant containing a polyoxyethylene group and having an HLB of 8 or more and 20 or less.

18. The method for washing clothing according to claim 15, wherein the component (C) is a nonionic surfactant having an HLB of 8 or more and 20 or less and represented by the following general formula (C5-1):

$$R^1(CO)_m O\text{-}(A^1O)n\text{-}R^2 \quad \text{(C5-1)}$$

wherein $R^1$ is an aliphatic hydrocarbon group having 9 or more and 16 or less carbon atoms, $R^2$ is a hydrogen atom or a methyl group, CO is a carbonyl group, m is 0 or 1, $A^1O$ group is one or more groups selected from an ethyleneoxy group and a propyleneoxy group, and n is an average number of added moles and is 6 or more and 50 or less.

19. A method for enhancing a detergent activity of the following component (B), wherein, at the time of washing clothing with a detergent liquid having a pH of 3.5 or more and 8.5 or less at 20° C. obtained by mixing the component (B) and water having a hardness, the following component (A) is present in the detergent liquid:

component (A): an internal olefin sulfonate having 15 or more and 24 or less carbon atoms with the sulfonate group at position 2 or higher and position 4 or lower and an olefin having 15 or more and 24 or less carbon atoms with the sulfonate group at position 5 or higher; and component (B): protease.

* * * * *